US006486102B1

(12) United States Patent
Derule et al.

(10) Patent No.: US 6,486,102 B1
(45) Date of Patent: Nov. 26, 2002

(54) OIL-IN-WATER EMULSION COMPRISING AT LEAST ONE LUBRICATING ADDITIVE

(75) Inventors: Hervé Derule, Metz (FR); Hubert Jacobs, Thionville (FR); Amadou Dicko, Metz Vallieres (FR); Peggy Guinet, Yutz (FR)

(73) Assignee: Unisor, Puteaux (FR)

( * ) Notice: Subject to any disclaimer, the term of this patent is extended or adjusted under 35 U.S.C. 154(b) by 0 days.

(21) Appl. No.: 09/890,102

(22) PCT Filed: Jan. 28, 2000

(86) PCT No.: PCT/FR00/00187

§ 371 (c)(1),
(2), (4) Date: Sep. 28, 2001

(87) PCT Pub. No.: WO00/44861

PCT Pub. Date: Aug. 3, 2000

(30) Foreign Application Priority Data

Jan. 28, 1999 (FR) ..... 99 00926

(51) Int. Cl.[7] ..... C10M 173/00
(52) U.S. Cl. ..... 508/430; 508/429; 508/431
(58) Field of Search ..... 508/430, 431, 508/429

(56) References Cited

U.S. PATENT DOCUMENTS 2,530,339 A * 11/1950 Mikeska et al. ..... 508/430
3,350,348 A * 10/1967 Braid et al. ..... 508/430
3,567,638 A * 3/1971 Braid ..... 508/430
3,865,906 A * 2/1975 Shin et al. ..... 508/430
4,333,841 A * 6/1982 Schmidt et al. ..... 508/431
4,349,445 A * 9/1982 Rosenberger ..... 508/430
5,362,419 A * 11/1994 Zinke et al. ..... 558/179
5,391,396 A * 2/1995 Morrand ..... 427/156
5,531,911 A * 7/1996 Adams et al. ..... 508/408
5,922,657 A * 7/1999 Camenzind et al. ..... 508/430
5,968,880 A * 10/1999 Mathur et al. ..... 508/431

* cited by examiner

*Primary Examiner*—Jacqueline V. Howard
(74) *Attorney, Agent, or Firm*—Sughrue Mion, PLLC

(57) ABSTRACT

An emulsion used to lubricate the surface of a steel sheet, comprising an additive corresponding to one of the following formulae: $(R_{1-2}—O—)_{1-2}—PSS—(CH_2)_n—COO—(CH_2)_m—CH_3$, $(R_{1-2}—O—)_{1,2}—PSS—CH2-\phi-O—H$, $(R_{1,2}—O—)_{1,2}—PSS—CH_2-\phi-O—(CH_2)_n$, $—COO—(CH_2)_m$, $—CH_3$, where PSS designates a dithiophosphate function. The naked sheets of steel that are treated with said emulsion have very good tribological properties even when the density of the emulsion thus applied is less than or equal to 1 g/m$^2$ when dry. The invention enables dry-looking oiled sheets to be obtained, whereby no re-oiling is required before forming even by die stamping.

11 Claims, 5 Drawing Sheets

OIL-IN-WATER EMULSION COMPRISING AT LEAST ONE LUBRICATING ADDITIVE

Figure 1:
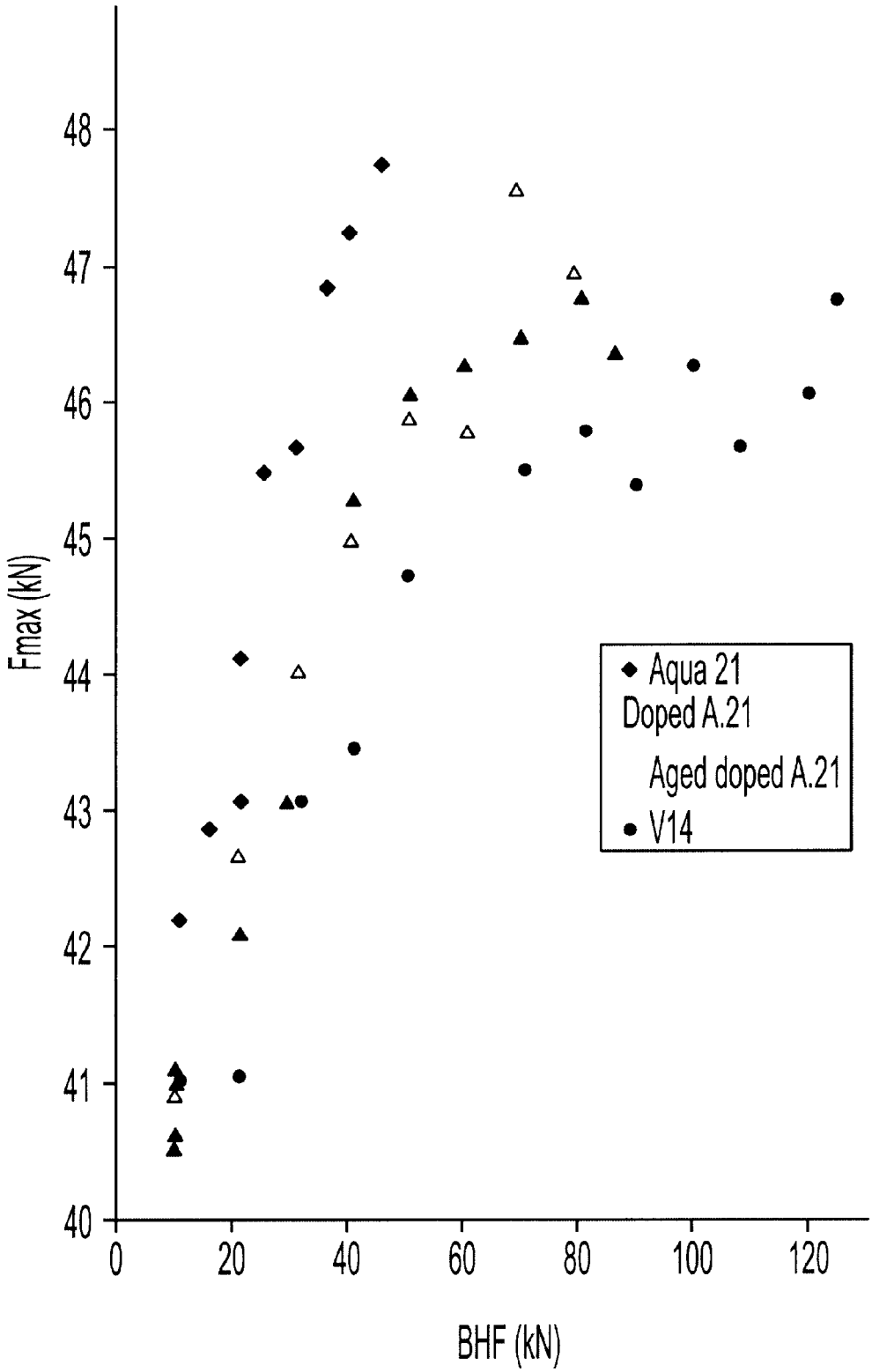

This application is a 371 of PCT/FR00/00187 Jan. 28, 2000.

The invention relates to an additive for soluble oil, intended to increase the lubricity of this oil, especially when it is applied as a thin and "dry" film to a steel surface.

This type of soluble oil is used in metal-working operations, as described for example in patent U.S. Pat. No. 4,027,512.

To prepare the operations of forming bare steel sheet, for example by drawing, it is known to carry out an oiling treatment on the surface of this sheet intended to come into contact with the surfaces of the forming tools.

This oiling treatment is intended to provide good lubrication between the sheet surface and the surface of the tools under the forming conditions.

Applied to bare steel sheet, this oiling treatment often has another function, of temporarily providing corrosion protection, as described in patent EP 0 577 486 (Sollac).

To carry out "oiling"-type surface treatments, it is known to use:

- either oils called "whole" oils, that is to say those being in the form of an oily homogeneous liquid phase;
- or oils called "soluble" oils, that is to say those which can be emulsified in water and applied as an emulsion, the emulsion having at least two different phases—an aqueous liquid phase and an oily phase dispersed in the liquid phase.

An advantage of soluble oils over whole oils is that they make it possible to obtain more easily homogeneous coatings which are very thin or have a very low surface density, for example less than or equal to 1 g/m$^2$.

This is because, unlike whole oils, soluble oils may be easily applied by spraying. This makes it possible to ensure that there is a homogeneous coating of very small thickness on the surface to be treated.

The abovementioned patent EP 0 577 486 describes a method of treating the surface of a metal workpiece using an oil emulsion; according to the invention forming the subject matter of that patent, this treatment is suitable for forming, on this surface, a thin homogeneous and protective film, of dry appearance, with a surface density of less than 1 g/m$^2$.

The abovementioned patent U.S. Pat. No. 4,027,512 describes the use of fatty acids as additives for increasing the lubricity of soluble oils for the working of metals and the method of incorporating these additives into emulsions.

Among the advantages associated with the application of very thin oil films to metal surfaces, mention may be made of:

- the ease of handling these workpieces, because they do not have a "greasy" appearance;
- the elimination, in certain cases, of a cleaning step prior to subsequent conversion operations such as, for example enameling or painting;
- on the other hand, should subsequent cleaning be necessary, the cleaning is easy since the amounts of oil to be removed are smaller;
- the possibility of obtaining effective temporary corrosion protection, especially on bare steel sheet, as described in the abovementioned patent EP 0 577 486.

Unfortunately, the lubricating properties of the thin films obtained from an oil-in-water emulsion are generally inferior to those of thicker films obtained by applying whole oils; this is because, on a thin film:

- problems of chattering often arise;
- the friction coefficient and/or the maximum drawing force (as defined in the "METHODS" section below) are too high.

It is an object of the invention to propose an additive for increasing the lubricity of soluble oils when they are applied to bare steel surfaces, especially when they are applied as a thin dry film to these surfaces.

For this purpose, the subject of the invention is an oil-in-water emulsion intended for a lubrication treatment of a steel surface, containing at least one lubrication additive chosen from the group comprising the products corresponding to the following formulae:

- $(R_{1,2}—O—)_{1,2}—PSS—(CH_2)_n—COO—(CH_2)_m—CH_3$ with n and m chosen so that $n+m \geqq 22$;
- $(R_{1,2}—O—)_{1,2}—PSS—CH_2\text{-}\Phi\text{-}OH$, or hydroxybenzyl O,O'-dialkyl dithiophosphates;
- $(R_{1,2}—O—)_{1,2}—PSS—CH_2\text{-}\Phi\text{-}O—(CH_2)_{n'}—COO—(CH_2)_{m'}—CH_3$ with n' and m' having any value, where PSS denotes the dithiophosphate functional group, $(R_{1,2}—O—)_{1,2}—$ denotes O,O'-dialkyl terminal groups, $—CH_2\text{-}\Phi\text{-}OH$ denotes the hydroxybenzyl functional group and $—CH_2\text{-}\Phi\text{-}O—$ the benzyloxy functional group.

The invention also has one or more of the following characteristics:

- if the additive satisfies the formula $(R_{1,2}—O—)_{1,2}—PSS—(CH_2)_n—COO—(CH_2)_m—CH_3$, n and m are each greater than or equal to 3;
- if the additive satisfies the formula $(R_{1,2}—O—)_{1,2}—PSS—CH_2\text{-}\Phi\text{-}O—(CH_2)_{n'}—COO—(CH_2)_{m'}—CH_3$, n' and m' are each greater than or equal to 3;
- if the additive satisfies the formula $(R_{1,2}—O—)_{1,2}—PSS—CH_2\text{-}\Phi\text{-}OH$, no other polar group than the —OH functional group is grafted to the aromatic ring Φ of the hydroxybenzyl functional group.

Preferably, the proportion of lubrication additive in the oily phase of the emulsion is between 2% and 6%.

The subject of the invention is also a treatment method for the lubrication of a steel surface, comprising the steps of applying this emulsion to this surface followed by a drying step suitable for forming a dry film on said surface, the dry film preferably having a surface density of less than or equal to 1 g/m$^2$.

The subject of the invention is also the use of this treatment method for lubricating a steel sheet before it is formed, since the oiled sheet with a dry appearance obtained by this treatment method does not need to be reoiled before the forming operation, especially by drawing.

If the lubrication treatment method according to the invention is applied to a sheet intended to be enameled or to be painted, the invention advantageously avoids having to carry out any cleaning operation after this lubrication and prior to this actual enameling or painting, especially if the dry film which results from this treatment has a surface density of less than or equal to 1 g/m$^2$, and even if a forming operation is interposed between the lubrication treatment and the enameling or painting operation.

The invention will be more clearly understood from the description which follows, this being given by way of nonlimiting example, and with reference to the appended FIGS. 1 to 7 which illustrate the variations in the maximum drawing force ($F_{max}$ in kN) as a function of the blank-holder force (BHF in kN) measured on various steel sheet specimens under the conditions indicated in the "METHODS" section and in the detailed description of examples 1, 5 to 8 and comparative example 1.

The preparation of an emulsion according to the invention will now be described.

The components needed to prepare the emulsion are: the oil or oils, the emulsifier or emulsifiers for forming and maintaining the emulsion and, according to the invention, at least one lubrication additive satisfying the formula:

$(R_{1,2}—O—)_{1,2}—PSS—(CH_2)_n—COO—(CH_2)_m—CH_3$ with n and m chosen so that $n+m \geqq 22$;

$(R_{1,2}—O—)_{1,2}—PSS—CH_2\text{-}\Phi\text{-}OH$, or hydroxybenzyl O,O'-dialkyl dithiophosphates;

$(R_{1,2}—O—)_{1,2}—PSS—CH_2\text{-}\Phi\text{-}O—(CH_2)_{n'}—COO—(CH_2)_{m'}—CH_3$ with n' and m' having any value, where PSS denotes the dithiophosphate functional group.

These components form the "oily base" to which water is merely added in order to obtain the emulsion according to the invention.

The nature and the proportions of the oils and emulsifiers used are known per se and will not be described here in detail.

Other additives may be added to the "oily base" or to the emulsion, such as corrosion inhibitors, filmforming agents, antifoam agents, bactericides, or other agents; these additives are known per se and will not be described here in detail.

To produce the lubrication additive according to the invention, reference will be made to the indications given in the examples below.

The proportions of lubrication additive to be added to the oily base are preferably between about 2% and 6%; with 2%, a significant effect is observed, but most of the tests were carried out with 5%.

To produce the treatment emulsion, the various liposoluble components of the oily base, including the lubrication additives according to the invention, are firstly mixed together and then the oily base obtained is emulsified by adding water with vigorous stirring; the proportion of water or the (aqueous phase)/(oily phase) ratio is adapted in a conventional manner.

The method of treating a steel surface using this emulsion according to the invention will now be described.

The steel surface to be treated is a surface of a sheet intended to be formed, for example by drawing.

For a sheet drawing operation, it is often necessary to pre-oil the drawing tools and the sheet.

In the case of oiling the sheet, the emulsion according to the invention will therefore be used; a uniform layer of emulsion is therefore conventionally applied to the sheet, for example by spraying or by dipping, and then the layer applied is dried, for example by blowing hot air, so as to obtain a uniform dry film on the steel surface of the sheet; this method of application followed by drying is described, for example, in the abovementioned patent EP 0 577 486.

The drying is designed to remove almost all the water from the emulsion layer applied; the drying is not excessively vigorous in order to avoid any risk of degrading the components of the oily base.

Thus, a steel sheet treated according to the invention, that is to say coated with a film based on an oil containing the lubrication additive according to the invention, is obtained.

By carrying out comparative drawing tests on this steel sheet treated according to the invention and on the same steel sheet treated in the same way using an identical emulsion except that it does not contain a lubrication additive according to the invention, it is found that the steel sheet treated according to the invention has much better tribological properties than the steel sheet treated using the emulsion not containing an additive; this observation demonstrates the lubrication-enhancing effect provided by this additive, at least when it is applied to a bare steel surface.

It has been found that the lubrication-enhancing effect provided by this additive added to oils was not observed on any metal surface: on the contrary, there is a reduction in the lubrication when the emulsion according to the invention is applied to galvanized sheet; thus, the invention relates more particularly to the lubrication of bare steel sheet.

The improvement in the tribological properties is also manifested by the chattering problems completely disappearing.

Finally, it has been found that the lubrication properties provided by the dry film applied to the sheet remain excellent even if this film is very thin to the point of having a surface density of less than or equal to 1 $g/m^2$.

This advantage of the invention is of great benefit since from this thus stem all the abovementioned advantages when very thin oil films are applied to metal surfaces, especially those relating to cleaning or to the fact that subsequent cleaning is unnecessary.

Furthermore, using oily bases suitable for temporary corrosion protection and incorporating additives according to the invention, steel sheet coated with a thin film of dry appearance is thus obtained, which film provides both:

corrosion resistance high enough to protect the sheet during transportation and storage; and tribological properties high enough to allow the sheet to be drawn directly without another reoiling operation beforehand.

Thus, the lubrication additive according to the invention is compatible with the components of the oily bases suitable for providing temporary corrosion protection, especially corrosion inhibitors.

Further advantages of the method of the invention will become apparent on reading the description of the nonlimiting examples of the present invention which are given hereinbelow.

EQUIPMENT:

1/ Nature of the lubrication additives according to the invention: see the examples.

2/ Nature of the oils used:

Two types of oil were used:

a soluble-type oil, called AQUASAFE 21 from Castrol, generally used for temporary corrosion protection of steel workpieces;

two whole oils:

one acting as a control, without any other additive, called V14 from Fuchs, generally used for treating steel workpieces both for corrosion protection and for lubrication before drawing;

and the other, denoted S3282 from Shell.

3/ Production of the treatment solutions or emulsions incorporating an additive:

The proportions of lubrication additive were, in the case of addition, 5% by weight with respect to the oily base:

in respect of the emulsion, the additive according to the invention was mixed with the AQUASAFE 21 oily base and then the oily mixture was emulsified, with stirring;

in the case of the use of whole oil incorporating an additive (comparative test), the lubrication treatment product was prepared by mixing the additive according to the invention in the oily base, in this case Shell 3282.

4/ The sheet used for the lubrication treatment trials was a bare steel sheet 0.7 mm in thickness, taken directly off a continuous production line immediately downstream of a skin-pass operation, carried out dry, without oil; this sheet, the surface of which was moreover not greasy, was not cleaned.

5/ Application of the treatment solutions or emulsions to the sheet:

in respect of the emulsions: spraying then drying under conditions suitable for obtaining a dry film with a surface density of about 0.5 $g/m^2$;

in respect of the whole oils: spraying under conditions suitable for obtaining a film with a surface density of about 1.5 $g/m^2$.

Methods

1) Drawability Tests

A drawing machine suitable for producing cups with an inside diameter of 50 mm from sheet blanks 90 mm in diameter; a punch 50 mm in diameter, having a radius of curvature of 3 mm at the end, and a die 52.6 mm in diameter, having an internal rim with a radius of curvature of 3.5 mm, were used.

The drawing rate was set at 30 cm/min.; the maximum blank-holder force was 150 kN.

The machine was equipped with means for continuously controlling the drawing parameters, especially the blank-holder pressure, the drawing force and the travel of the punch.

During an operation of drawing a given sheet blank with a predetermined sheet blank pressure, the curve showing the variation in the drawing force as a function of the travel of the punch was plotted; this curve passes through a maximum which defines the maximum drawing force during the operation.

From a series of drawing operations with different blank-holder pressures, a series of maximum drawing force values was thus obtained; the curve showing the variation in the maximum drawing force ("$F_{max}$" in kN) as a function of the blank-holder pressure or force ("BHF" in kN) can then be plotted; these curves often correspond to straight lines, the slope of which characterizes the friction of the punch and of the die on the two faces of the sheet.

A gentle slope corresponds to low friction, that is to say to sheet well lubricated on both faces.

This drawing test protocol therefore made it possible to evaluate the level of lubrication of the surface of a sheet for the purpose of drawing it; to evaluate this level on a single face, a Teflon® film was placed on the other face (on the punch side) so as to obtain, on this other face, friction which was always negligible compared with that exerted on the surface to be evaluated.

To evaluate the lubricating effect of a surface treatment of the type according to the invention, this protocol was applied directly to sheet treated according to the invention, without subsequent oiling.

2) Corrosion Resistance Tests

Specimens whose surface had been corrosion-treated were placed in an environmental chamber programmed according to a succession of "wet/hot" cycles each lasting 24 hours:

8 hours at 40° C./100% relative humidity;

16 hours at 20° C./60% relative humidity.

To evaluate the corrosion resistance of a specimen, the number of cycles before rust appeared was determined.

EXAMPLE 1

Impact of an Additive $(R_{1,2}—O—)_{1,2}—PSS—CH_2-\Phi-OH$ According to the Invention on the Drawability Impact of Aging of the Emulsion Incorporating an Additive The additive used here according to the invention was nonsubstituted 4-hydroxybenzyl O,O'-diisopropyl dithiophosphate of general formula $(R_{1,2}—O—)_{1,2}—PSS—CH_2-\Phi-OH$, in which the radicals $R_1$ and $R_2$ are isopropyl radicals.

In this additive, the —OH radical is in the "para" position with respect to the $—CH_2—S—$ radical on the aromatic ring Φ of the benzyl radical.

For the preparation of this additive, reference may be made to the following documents:

the documents GB 1 506 917 (Shell) , U.S. Pat. Nos. 3,745,148 and 3,865,906 (Ethyl Corp.) describe various products of the same family as that of the additives according to the invention, which correspond to the family of unsubstituted or alkyl-substituted hydroxybenzyl O,O'-dialkyl dithiophosphates; these documents also describe processes for preparing these products and their use as antioxidants in high-viscosity lubricating compositions (GB 1 506 917) or synthetic rubbers (U.S. Pat. Nos. 3,745,148 and 3,865,906);

the document EP 592 956 (Lubrizol) describes a lubricating (whole or soluble) composition containing oil, an additive resulting from the reaction between a dimercaptothiadiazol and an aliphatic olefin, and, according to claim 5, from 0.1–1% to 5–7% of a metal dithiophosphate as extreme pressure agent (page 2, line 23—pages 12–13); example 5 specifically describes the use, as extreme pressure agent, of zinc isopropyl methylamyl dithiophosphate;

document EP 719 315 (Exxon) describes the use of metal O,O'-dialkyl dithiophosphates as antiwear agents in internal-combustion engine oils.

Thus, to synthesize the additives of hydroxybenzyl O,O'-dialkyl dithiophosphate-type additives, reference may especially be made to document U.S. Pat. No. 3,745,148 which, for this purpose, describes the use of the chlorides mentioned in column 4, lines 52 to 54 (in the case of unsubstituted hydroxybenzyl additives) and column 4, line 70 to column 5, line 35 (in the case of substituted hydroxybenzyl additives).

Tests were carried out both on specimens treated with an additive-incorporated emulsion which was freshly prepared and on specimens treated with an additive-incorporated emulsion which was "aged" in the sense that it was prepared three weeks before its application.

Thus, the following series of specimens were prepared under the conditions indicated in the EQUIPMENT section:

♦ symbol="AQUA 21": sheet treated with the non-additive-incorporated AQUASAFE 21 emulsion;

symbol="Doped A.21": sheet treated with the freshly prepared AQUASAFE 21 emulsion to which 5% by weight of unsubstituted 4-hydroxybenzyl O,O'-diisopropyl dithiophosphate with respect to the weight of the oily base was added according to the invention;

symbol="Aged doped A.21": the same specimens as those with the symbol above, but treated with an "aged" additive-incorporated emulsion;

symbol="V 14": sheet treated with the whole oil V14, containing no additive.

The drawability tests were carried out under the conditions indicated in the METHODS section and the results obtained are given in the from of a graph in which the blank-holder clamping force ("BHF" in kN) is plotted on the x-axis and the maximum drawing force ("$F_{max}$" in kN) is plotted on the y-axis; the graph obtained is given in FIG. 1.

These results clearly illustrate the improvement in the lubrication provided on the bare steel by the additive according to the invention in the case of the soluble oil AQUA- SAFE 21; it may also be deduced from these results that the aging of the emulsion does not significantly affect the tribological properties.

The results obtained with the emulsion according to the invention are substantially comparable to those obtained with the control whole oil, V14, applied with a surface density three times as great.

The invention therefore also makes it possible to reduce the consumption of oil very considerably.

Improvements in the lubrication have also been obtained with other very similar additives, for which the position of the —OH radical is different, such as 2-hydroxybenzyl O,O'-diisopropyl dithiophosphate and 3-hydroxybenzyl O,O'-diisopropyl dithiophosphate.

EXAMPLE 2

Impact of the Additive on the Friction Behavior

Using a conventional friction test tribometer with flat-on-flat contact, the behavior of the ♦ symbol specimens (no additive) was compared with the symbol specimens (additive according to the invention).

The friction behavior of the ♦ specimens (no additive) caused chattering problems, which completely disappeared on the specimens according to the invention.

According to the invention, the incorporation of an additive into soluble oils therefore improves the friction behavior of bare steel sheet.

EXAMPLE 3

Impact of the Additive on Corrosion Resistance

The corrosion resistance tests were carried out under the conditions indicated in the METHODS section on four series of specimens, namely the series of specimens indicated by the ♦ symbols (no additive) and by the (invention) of example 1, and the same series of specimens after a drawing operation.

For these four series of specimens, no rusting appeared after 20 wet/hot cycles.

It therefore seems that additive incorporation into soluble oil according to the invention does not degrade the corrosion protection provided by the AQUASAFE 21 oily base on a bare steel sheet, even after this treated sheet has been drawn.

EXAMPLE 4

Enamelability of the Specimens Treated Using an Additive-incorporated Oil, without Precleaning In order to enamel an oiled sheet, it is generally necessary to clean it beforehand; if the oil film applied to the surface is sufficiently thin and cleanable, this cleaning operation is no longer necessary; the purpose of this example is to confirm that the incorporation of an additive according to the invention does not impair this advantage and that the cleanability is not affected.

Several conventional enameling tests were carried out on the specimens:

- direct-on enameling: one coat/one bake with no surface pretreatment;
- two-coat/two-bake enameling: the first coat serving as the ground base for the second coat, which gives the final appearance, with a single bake.

The results obtained show that incorporating the additive into the AQUASAFE 21 oily base does not modify the enameling behavior without precleaning, whatever the type of enameling used; in each case, a good appearance and good adhesion was found.

EXAMPLE 5

Hydroxybenzyl O,O'-dialkyl Dithiophosphate Additives: Impact of a Polar Group on the Aromatic Rinq The purpose of this example is to illustrate the advantage of the use of hydroxybenzyl O,O'-dialkyl dithiophosphates which are not substituted with polar groups.

Specimens were treated using freshly prepared emulsions and tested under the conditions of example 1.

Figure 2:
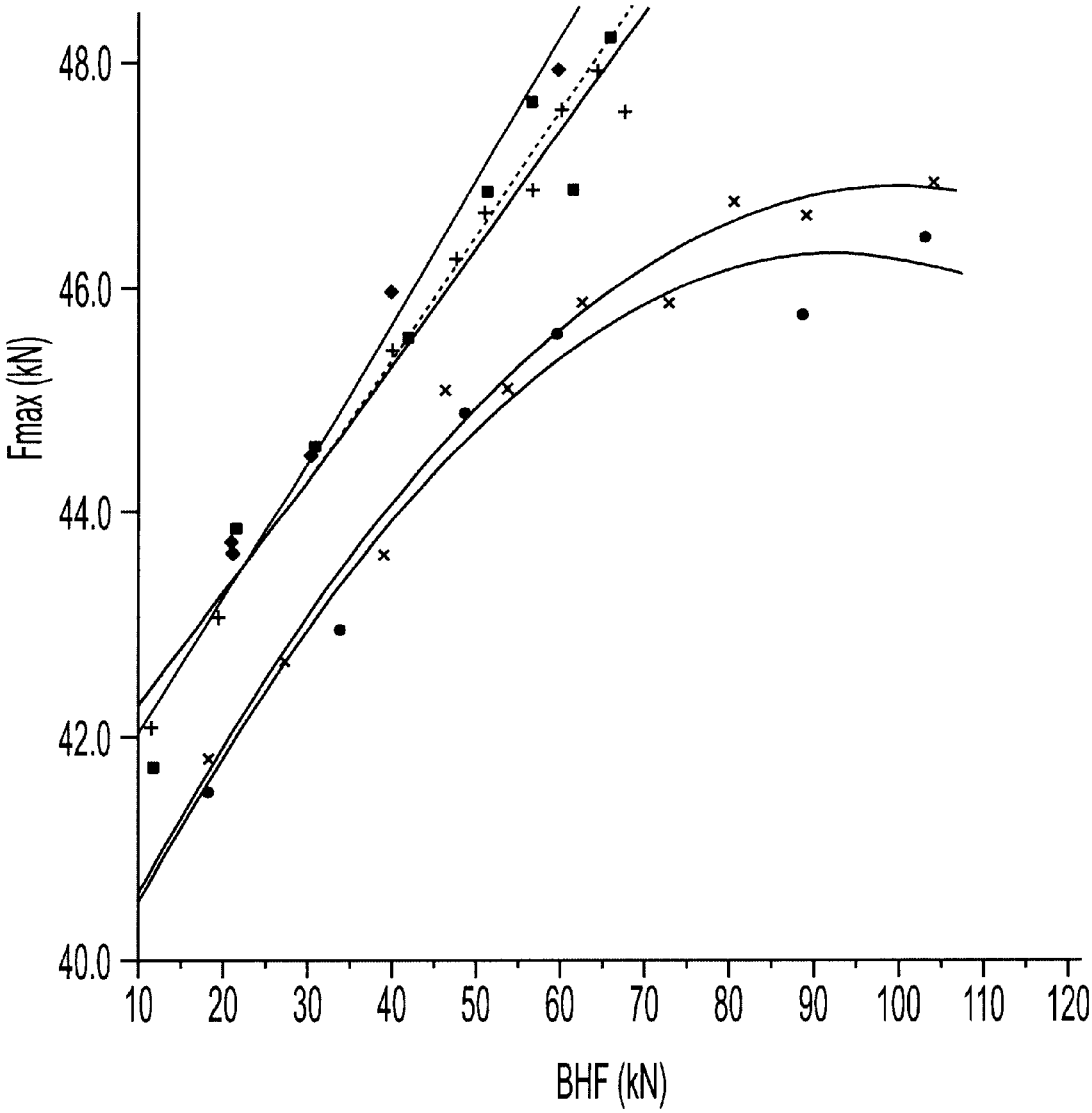

The results obtained are given in FIG. 2, in which, apart from the ♦ and symbols already explained in example 1:

- x denotes the unsubstituted hydroxybenzyl O,O'-diisopropyl dithiophosphate additive;
- denotes the 3-oxoethane-4-hydroxybenzyl O,O'-diisopropyl dithiophosphate additive;
- + denotes the unsubstituted 4-carboxybenzyl O,O'-diisopropyl dithiophosphate additive, the term "carboxy" denoting the —COOH radical.

These additives were synthesized by methods known per se, as described in the documents GB 1 506 917, U.S. Pat. Nos. 3,745,148 and 3,865,906 already mentioned.

According to these results, the unsubstituted hydroxybenzyl O,O'-diisopropyl dithiophosphate additive (x symbol) provides the best drawability with regard to the maximum drawing force, the other additives tested improving the drawability only with respect to chattering (cf. example 2).

With regard to the functional group or groups grafted onto the aromatic ring Φ of the hydroxybenzyl functional group, it may be deduced from this that:

- the "carboxy" functional group does not provide a result comparable to that of the "hydroxy" functional group;
- it is preferable that no other polar group than the —OH functional group be grafted onto the aromatic ring Φ.

EXAMPLE 6

Drawability Tests on a Galvanized Surface: Unfavorable Impact of the Additive According to the Invention The purpose of this example is to show that the improvement in the tribological properties relating to the incorporation of an additive into soluble oils according to the invention is specific to bare steel and that, on the contrary, on coated steel, for example on galvanized steel, this additive incorporation causes these properties to deteriorate.

1. Nature of the soluble oils used:
   - AQUASAFE 21, already mentioned, but which was not adapted to galvanized sheet;
   - Soluble oil with the reference 6130 from Quaker, adapted to the treatment of galvanized sheet.
2. Additive according to the invention: 4-hydroxybenzyl O,O'-diisopropyl dithiophosphate at 6 g/l of oily base.
3. Sheet used: steel sheet coated by electro-deposition in a chloride medium with a zinc coat having a thickness of the order of 10 $\mu$m.

Figure 3:
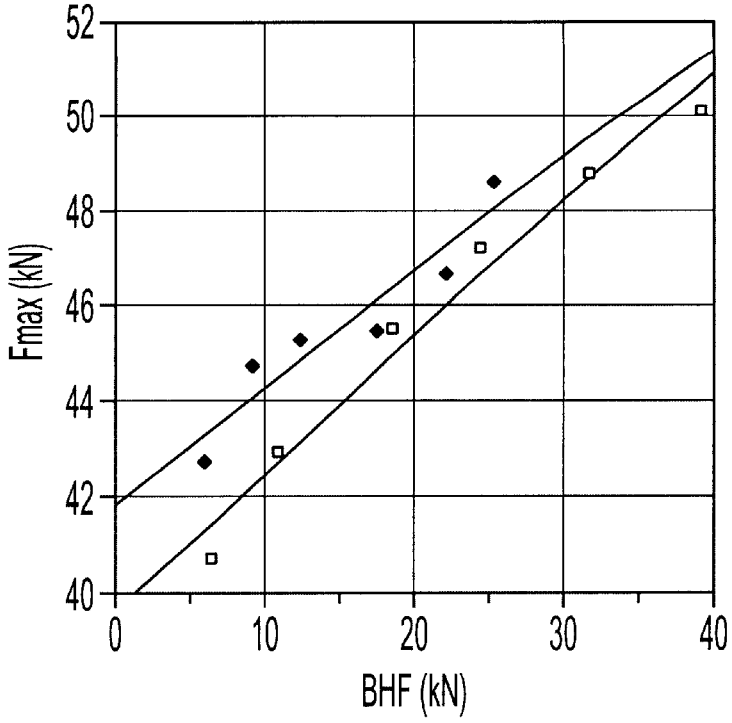
Figure 4:
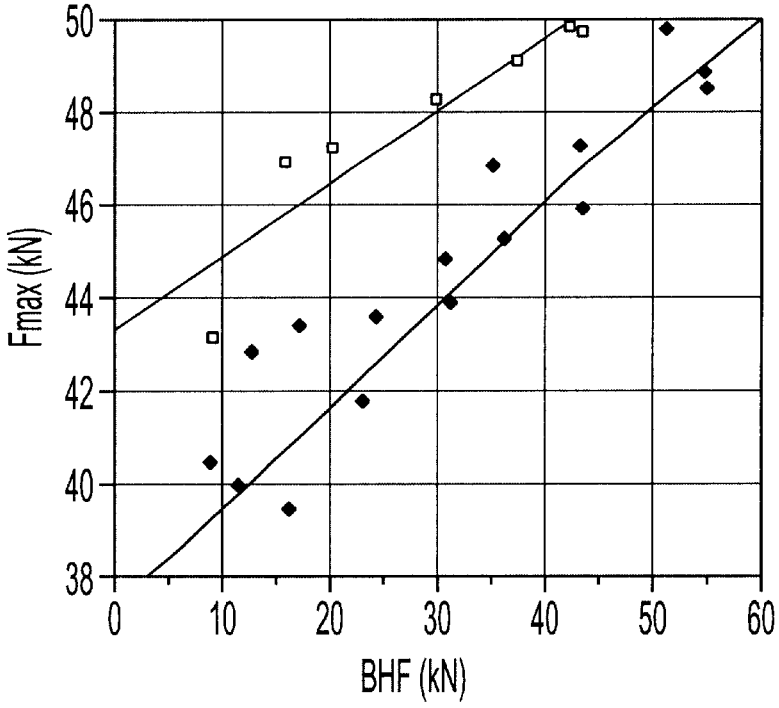

The results of the drawability tests, carried out and presented as in example 1, are given in FIGS. 3 and 4:

- FIG. 3 relates to the AQUASAFE 21 oily base: the ➢ symbol relates to the results obtained with oil without additive incorporation, the ♦ symbol relates to the results obtained with additive-incorporated oil;
- FIG. 4 relates to the 6130 oily base: the ♦ symbol relates to the results obtained with oil without additive incorporation and the ➢ symbol relates to the results obtained with additive-incorporated oil.

It was thus found, especially in the case of the 6130 oily base, that additive incorporation results in an increase in the maximum drawing force and therefore the tribological properties of galvanized sheet deteriorate.

EXAMPLE 7

Impact of the Additives of Type $(R_{1,2}—O—)_{1,2}—PSS—(CH_2)_n—COO—(CH_2)_m—CH_3$ on the Drawability: Importance of the Length of the Carbon Chain (n+m)

The additives used here were the following:

additive 1: $(IPr—O—)_2—PSS—(CH_2)_3—COO—(CH_2)_2—CH_3$ additive 2: $(IPr—O—)_2—PSS—(CH_2)_6—COO—(CH_2)_4—CH_3$ additive 3: $(IPr—O—)_2—PSS—(CH_2)_{12}—COO—(CH_2)_{10}—CH_3$ where IPr denotes the isopropyl group.

These compounds were synthesized, for example, as follows:

a halide of formula $X—(CH_2)_n—COO—CH_2)_m—CH_3$, where X denotes a halide, was firstly synthesized by making an alcohol halide $X—(CH_2)_n—OH$ react with an acid chloride $Cl—COO—(CH_2)_m—CH_3$;

next, the halide obtained was made to react with potassium O,O'-diisopropyl dithiophosphate, by a nucleophilic substitution reaction, for example in an 80% water/20% ethanol mixture at reflux for 72 hours.

Next, series of specimens were prepared under the conditions indicated in the EQUIPMENT section:

control specimens treated using an oil with no additive incorporated: firstly "Aquasafe 21" (♦ symbol) and secondly "V14" (symbol);

specimens treated using additive-incorporated Aquasafe 21 oil: "Aquasafe 21+Add.1", "Aquasafe 21+Add.2" and "Aquasafe 21+Add.3" for additives 1, 2 and 3, respectively.

Figure 5:
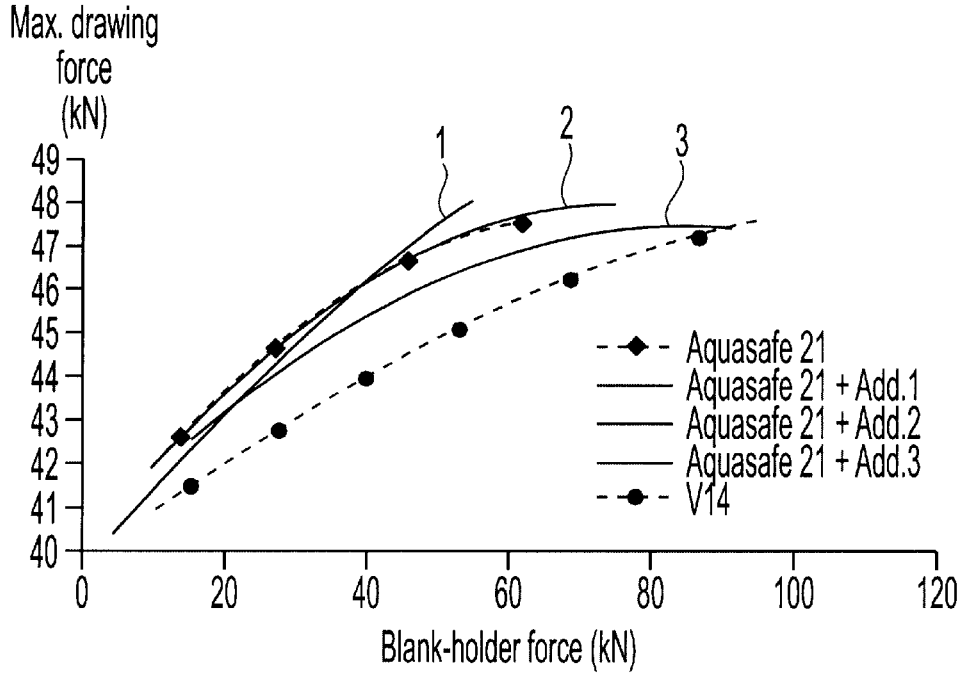

The drawability tests were carried out under the conditions indicated in the METHODS section and the results obtained are given in the form of a graph in which the blank-holder clamping force (in kN) is plotted on the x-axis and the maximum drawing force (in kN) is plotted on the y-axis; the graph obtained is shown in FIG. 5.

It may therefore be seen that additive 1 degrades the lubricating properties of Aquasafe 21 oil, additive 2 does not modify them while additive 3 substantially improves them.

It may therefore be deduced from this that the length (n+m) of the carbon chain of the $—(CH_2)_n—COO—(CH_2)_m—CH_3$ terminal group has a major impact on the lubricating properties and that, in order for an additive of general formula $(R_{1,2}—O—)_{1,2}—PSS—(CH_2)_n—COO—(CH_2)_m—CH_3$ to be effective, it is necessary for $n+m \geqq 22$.

EXAMPLE 8

Impact of the Additives of Type $(R_{1,2}—O—)_{1,2}—PSS—(CH_2)\text{-}\Phi\text{-}O—(CH_2)_{n'}—COO—(CH_2)_{m'}—CH_3$ on the Drawability The additives used here were the following:

additive 1': $(IPr—O—)_2—PSS—CH_2\text{-}\Phi\text{-}O—(CH_2)_3—COO—(CH_2)_2—CH_3$ additive 2': $(IPr—O—)_2—PSS—CH_2\text{-}\Phi\text{-}O—(CH_2)_6—COO—(CH_2)_4—CH_3$ additive 3': $(IPr—O—)_2—PSS—CH_2\text{-}\Phi\text{-}O—(CH_2)_{12}—COO—(CH_2)_{10}—CH_3$ where IPr denotes the isopropyl group.

These compounds were synthesized, for example, as follows:

a halide of formula $X—PSS—CH_2\text{-}\Phi\text{-}O—(CH_2)_n$, $—COO—(CH_2)_m$, $—CH_3$, where X denotes bromine, was firstly synthesized by radical substitution of the aromatic methylenes by N-bromosuccinimide in a carbon tetrachloride solution in the presence of a catalyst of formula AIBN as freeradical initiator;

next, additives 1', 2' and 3' were obtained by substitution of the para-substituted benzylbromides on the potassium O,O'-diisopropyl dithiophosphate in ethanolic medium.

Next, series of specimens were prepared under the conditions indicated in the EQUIPMENT section:

control specimens treated using oil with no additive incorporated: firstly "Aquasafe 21" (♦ symbol) and secondly "V14" (symbol);

specimens treated using additive-incorporated Aquasafe 21 oil: "Aquasafe 21+Add.1'", "Aquasafe 21+Add.2'" and "Aquasafe 21+Add.3'" in the case of additives 1', 2' and 3', respectively.

Figure 6:
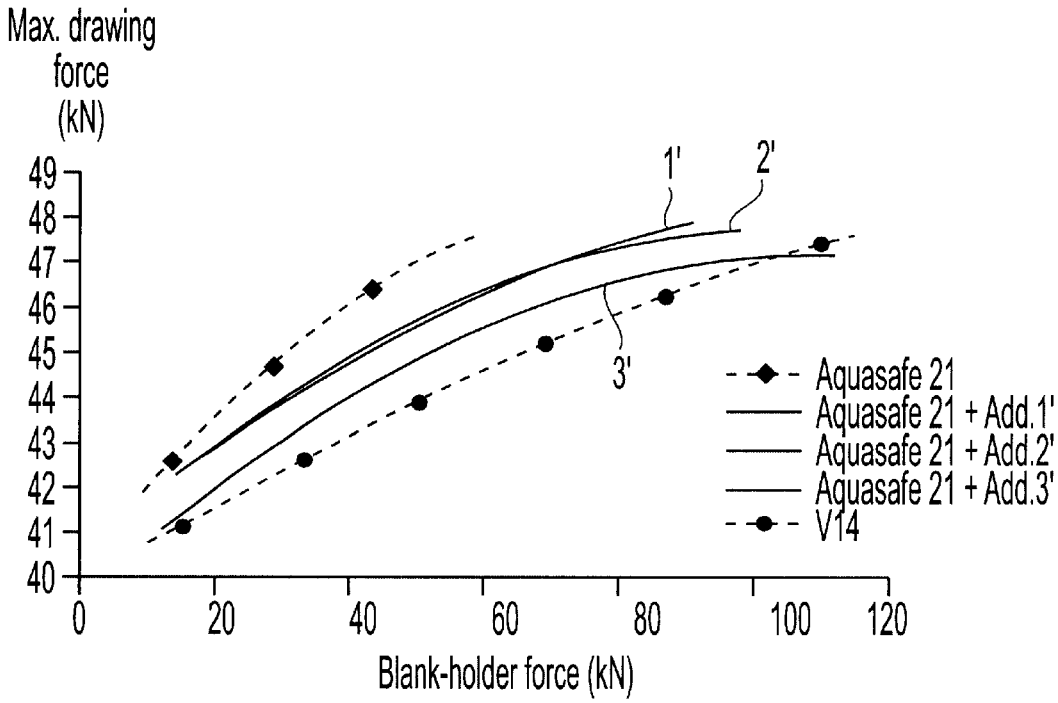

The drawability tests were carried out under the conditions indicated in the METHODS section and the results obtained are given in the form of a graph in which the blank-holder clamping force (in kN) is plotted on the x-axis and the maximum drawing force (in kN) is plotted on the y-axis; the graph obtained is shown in FIG. 6.

It may therefore be seen that additives 1' and 2' appreciably improved the lubricating properties of the Aquasafe 21 oil, additive 3' giving the best results.

From this it may therefore be deduced that the length (n+m) of the carbon chain of the $—(CH_2)_n—COO—(CH_2)_m—CH_3$ terminal group does not have a very significant impact on the lubricating properties; however, for an additive of general formula $(R_{1,2}—O—)_{1,2}—PSS—(CH_2)_n—COO—(CH_2)_m—CH_3$, the best results are obtained if $n+m \geqq 22$.

Comparative Example 1

The purpose of this example is to illustrate the importance of the phosphorus-sulfur-containing functional group of the additives according to the invention.

For this purpose, an additive of formula $CH_3\text{-}\Phi\text{-}O—(CH_2)_6—COO—(CH_2)_4—CH_3$ was prepared, this additive being similar to additive 2' of example 8 but not including a phosphorus-sulfur-containing functional group.

Next, series of specimens were prepared under the conditions indicated in the EQUIPMENT section:

control specimens treated using oil with no additive incorporated: firstly "Aquasafe 21" (♦ symbol) and secondly "V14" (symbol);

specimens treated using Aquasafe 21 oil with a "$CH_3$—Ph—O-wax" additive incorporated, to represent the non-phosphorus-sulfur-containing additive above.

Figure 7:
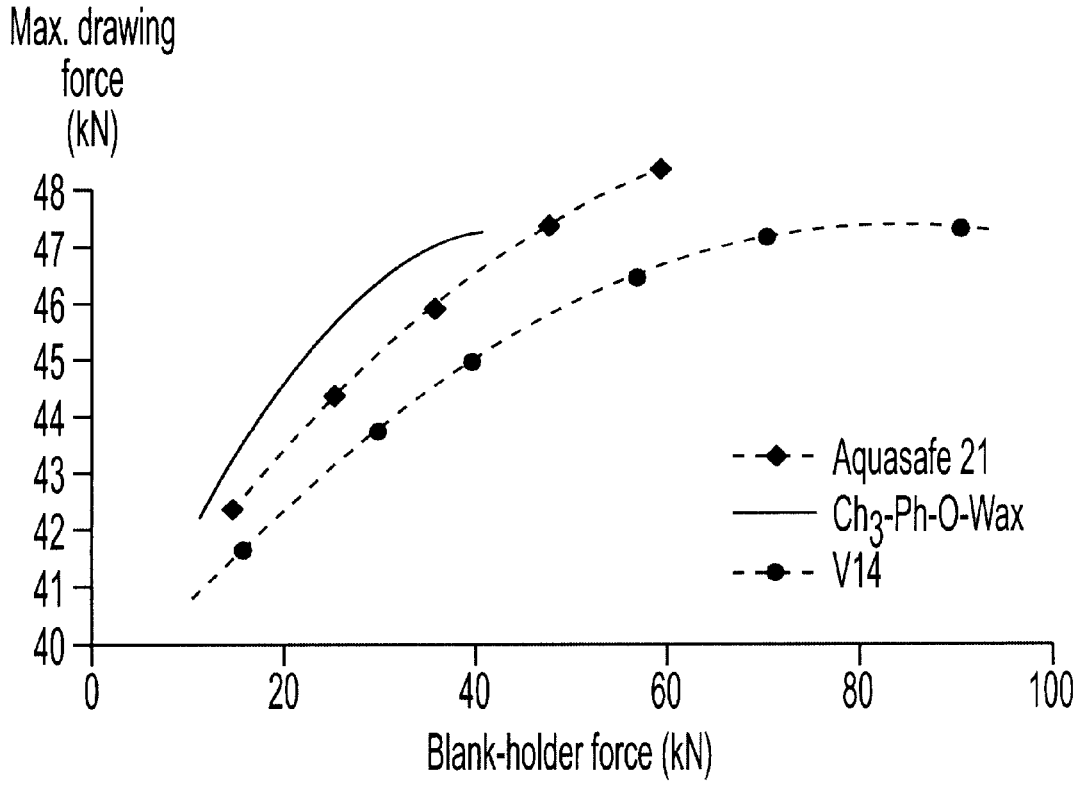

The drawability tests were carried out under the conditions indicated in the METHODS section and the results obtained are given in a graph in which the blank-holder clamping force (in kN) is plotted on the x-axis and the maximum drawing force (in kN) is plotted on the y-axis; the graph obtained is shown in FIG. 7.

It may therefore be seen that the non-phosphorus-sulfur-containing additive degrades the lubricating properties of the Aquasafe 21 oil; by comparing the results in example 8, it may be deduced that the phosphorus-sulfur-containing functional group of the additives according to the invention is essential for achieving the aim of improving the lubricating properties as the invention purports.

What is claimed is:

1. An oil-in-water emulsion intended for a lubrication treatment of a steel surface, containing at least one lubrication additive chosen from the group comprising the products corresponding to the following formulae:

$(R_{1,2}—O—)_{1,2}—PSS—(CH_2)_n—COO—(CH_2)_m—CH_3$ with n and m chosen so that $n+m \geqq 22$;

$(R_{1,2}—O—)_{1,2}—PSS—CH_2$-Φ-OH, or hydroxybenzyl O,O'-dialkyl dithiophosphates;

$(R_{1,2}—O—)_{1,2}—PSS—CH_2$-Φ-O—$(CH_2)_{n'}—COO—(CH_2)_{m'}—CH_3$ with n' and m' having any value, where PSS denotes the dithiophosphate functional group, $(R_{1,2}—O—)_{1,2}$— denotes O,O'-dialkyl terminal groups, —$CH_2$-Φ-OH denotes the hydroxybenzyl functional group and —$CH_2$-Φ-O— the benzyloxy functional group.

2. The emulsion as claimed in claim 1, in which at least one additive satisfies said formula $(R_{1,2}—O—)_{1,2}—PSS—(CH_2)_n—COO—(CH_2)_m—CH_3$, characterized in that n and m are each greater than or equal to 3.

3. The emulsion as claimed in claim 1, in which at least one additive satisfies said formula $(R_{1,2}—O—)_{1,2}—PSS—CH_2$-Φ-O—$(CH_2)_{n'}—COO—(CH_2)_{m'}—CH_3$, characterized in that n' and m' are each greater than or equal to 3.

4. The emulsion as claimed in claim 1, in which at least one additive satisfies said formula $(R_{1,2}—O—)_{1,2}—PSS—CH_2$-Φ-OH, characterized in that no other polar group than the —OH functional group is grafted to the aromatic ring Φ of the hydroxybenzyl functional group.

5. The emulsion as claimed in claim 1, characterized in that the radicals $R_1$ and $R_2$ of the O,O'-dialkyl terminal groups represented by $(R_1—O—)$— and $(R_2—O—)$— each denote isopropyl radicals.

6. The emulsion as claimed in claim 1, characterized in that the proportion of the at least one lubrication additive in the oily phase of the emulsion is between 2% and 6%.

7. A treatment method for the lubrication of a steel surface, comprising the steps of applying an emulsion as claimed in claim 1 to this surface followed by a drying step suitable for forming a dry film on said surface.

8. The method as claimed in claim 7, characterized in that said dry film has a surface density of less than or equal to 1 $g/m^2$.

9. The method as claimed in claim 7 wherein the steel surface is lubricated before forming.

10. A method of enameling a bare steel sheet, which includes a lubrication treatment as claimed in claim 8 followed by an enameling operation proper, characterized in that it includes no cleaning operation between said lubrication treatment and said enameling operation.

11. A method of painting a bare steel sheet, which includes a lubrication treatment as claimed in claim 8 followed by a painting operation proper, characterized in that it does not include a cleaning operation between said lubrication treatment and said painting operation.

* * * * *

UNITED STATES PATENT AND TRADEMARK OFFICE

CERTIFICATE OF CORRECTION

PATENT NO. : 6,486,102 B1
DATED : November 26, 2002
INVENTOR(S) : Herve Derule et al.

It is certified that error appears in the above-identified patent and that said Letters Patent is hereby corrected as shown below:

Title page,
Item [73], Assignee, should read as follows:

-- [73] Assignee: USINOR, Puteaux (FR) --.

Signed and Sealed this

Ninth Day of December, 2003

JAMES E. ROGAN
*Director of the United States Patent and Trademark Office*